US006869236B2

(12) United States Patent
Motoyanagi

(10) Patent No.: US 6,869,236 B2
(45) Date of Patent: Mar. 22, 2005

(54) PRINTING APPARATUS, PRINTING METHOD, AND PROGRAM

(75) Inventor: Yoshimune Motoyanagi, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 8 days.

(21) Appl. No.: 10/606,622

(22) Filed: Jun. 25, 2003

(65) Prior Publication Data

US 2004/0028441 A1 Feb. 12, 2004

(30) Foreign Application Priority Data

Jun. 28, 2002 (JP) ..... 2002-189723

(51) Int. Cl.[7] ..... B41J 3/42

(52) U.S. Cl. ..... 400/70; 400/61; 101/35; 101/38.1

(58) Field of Search ..... 400/61, 62, 70, 400/76; 101/4–7, 35, 38.1; 347/2, 12, 38

(56) References Cited

U.S. PATENT DOCUMENTS 5,317,337 A 5/1994 Ewaldt
5,518,325 A * 5/1996 Kahle ..... 400/70
5,967,676 A 10/1999 Cutler et al.
6,202,550 B1 * 3/2001 Lee et al. ..... 101/38.1
6,270,176 B1 * 8/2001 Kahle ..... 347/2

FOREIGN PATENT DOCUMENTS

GB 2 320 912 A 7/1998
JP 05-238005 A 9/1993

OTHER PUBLICATIONS

Patent Abstracts of Japan, vol. 2000, No. 03, Mar. 30, 2000 and JP 11–339441 A (Mitsumi Electric Co. Ltd.), Dec. 10, 1999—Abstract only.

* cited by examiner

*Primary Examiner*—Minh H Chau
(74) *Attorney, Agent, or Firm*—Frishauf, Holtz, Goodman & Chick, P.C.

(57) ABSTRACT

A character size is set according to the number of characters of a character string to be printed, and the number of printing operation times of a printer section and each operational condition of a rotation angle of a rotatable plate, which supports a recoding medium, which correspond to one printing operation, are set. According to the set operational condition, a part of the character string arranged in an arc shape is printed by one printing operation of the printer section in a state that the rotational plate is stopped, and the rotational plate is driven to rotate the recording medium by the set angle before a next printing operation is started. The printing operation and the rotating operation are repeated, thereby printing a series of character string on the circumference around a circular hole of the recording medium.

13 Claims, 11 Drawing Sheets

PRINTING APPARATUS, PRINTING METHOD, AND PROGRAM

BACKGROUND OF THE INVENTION

1. Field of the Invention

The present invention relates to a printing apparatus, printing method, and program that use a recording medium such as an optical disk as a printing object to print information such as a title of data recorded on the recording medium on its surface.

2. Description of the Related Art

Conventionally, the applicant of the present application has proposed printing apparatuses that print the title of an optical disk such as a CD-R (Compact Disk-Recordable) on its surface, and sold them in Japan.

This printing apparatus includes a tray that supports a disk and a printer mechanism that performs printing to the disk supported by this tray. The tray is moved to the external section of the apparatus main body by an inject operation, and the printer mechanism performs thermal transfer printing to the stationary optical disk, which is supported on the tray placed at a predetermined position of the apparatus main body, using an ink ribbon by a thermal head that moves backwards and forwards.

The aforementioned printer mechanism can arrange a character string in a linear or arc shape within one rectangular range corresponding to an effective print width, which the thermal head has, and a distance where the thermal head moves to scan, thereby making it possible to perform printing onto the surface of the optical disk by one print operation.

When a user wishes to provide printing to a plurality of portions of the surface (label surface) of the optical disk by the aforementioned printer mechanism, he/she performs the inject operation to once push the tray out of the apparatus after the end of printing one portion. Next, the user rotates the optical disk on the tray by a desired angle manually to be repositioned such that an area different from the print area at the first printing operation is made to correspond to the position of the printer mechanism. Thereafter, the user must return the tray to the apparatus main body to perform printing to a different portion of the optical disk by the second printing operation of the printer mechanism.

In addition, in the label printing of the optical disk, a character string is arranged circularly or semi-circularly along the circumference of a circular hole of the optical disk and this is useful as an arrangement form of the character string corresponding to the shape of the disc-like optical disk, and such a print result is desirably obtained.

As mentioned above, the printing apparatus can print the character string in an arc shape along the circumference around the circular hole of the optical disk. However, since the size of the rectangular print range where printing can be performed by one printing operation is decided, the print length of the character string where the characters are arranged in an arc shape is limited and the number of characters that forms the character string is also limited. Here, in the aforementioned printing apparatus, the print length of the arc-shaped character string that can be printed by one printing operation is about ⅕ of the circumference of the optical disk. For this reason, when the print character size of the arc-shaped character string is relatively increased, only the arc-shaped character string with the small number of characters can be printed. While, when the number of characters of the arc-shaped character string is relatively increased, the print character size of the arc-shaped character string becomes small as compared with the size of the optical disk. In this way, a good-looking print cannot be obtained by only one printing operation.

Additionally, it is not impossible to dividedly print the character string in a circular or semi-circular shape a plurality of times by the aforementioned printing apparatus. Namely, the user divides the character string to be printed in a circular or semi-circular shape to a plurality of character strings, and rotates the optical disk on the tray by a predetermined angle manually to be rearranged every time when each divided character string is printed on the optical disk in an arc shape, thereafter the user may return the tray to the apparatus main body to repeat the printing operation by a predetermined number of times.

However, it is complicated for the user to perform such an operation. Moreover, it is actually difficult to perform such an operation that accurately rotates the optical disk on the tray by the predetermined angle manually to be rearranged for each of the plurality of printing operation times. When there is an error in a rotation angle, such problems occur that a large space is generated between the adjacent characters at a boundary between the previous print portion and the print portion this time; inversely the adjacent characters are overlapped to degrade print quality.

As the printing apparatus other than the above, Unexamined Japanese Patent Application KOKAI Publication No.H5-238005 describes another printing apparatus that performs title-printing on the optical disk. This printing apparatus moves a print head of an ink jet device in a radial direction on the optical disk as rotating the optical disk to perform printing onto the optical disk spirally.

Since this printing apparatus can perform printing to the entirety of the label of the optical disk, it is possible to realize the print form in which the character string is arranged in a circular or semi-circular shape around the circular hole of the optical disk. However, since the print head is moved in the radial direction on the optical disk as rotating the optical disk to perform printing onto the optical disk spirally, it is necessary to control both the rotation of the optical disk and movement of the print head, causing a problem in which the control is complicated.

Moreover, this printing apparatus is one that drives the print head extending in the radial direction of the optical disk to rotate the optical disk one time to perform printing. In this printing apparatus, the rotational speed to the position close to the center on the optical disk is different from the position far therefrom and moving speed to the print head is slow at the position close to the center of the optical disk, so that a print result with high density can be obtained. In contrast to this, moving speed to the print head is fast at the position far from the center, so that a print result with low density can be obtained. For this reason, it is necessary to perform a specific print control to equalize print density at the position in the radial direction of the optical disk, causing a defect that control becomes further complicated.

SUMMARY OF THE INVENTION

An object of the present invention is to provide a small-sized and low-cost printing apparatus with a simple apparatus structure and printing method that can easily print a character string in a circular or arc shape on a circumference around the center of a recording medium such as an optical disk and the like.

In order to attain the above object, a printing apparatus according to a first aspect of the present invention comprises a rotational support section that rotatably supports a recording medium; a character string storing section that stores an input character string; a print section that prints the character string within a predetermined print range of the recording medium supported by the rotational support section by one printing operation; an arrangement pattern storing section, being prepared in advance, that stores a plurality of kinds of arrangement patterns to arrange the character string along a circle or arc having a predetermined length; an arrangement pattern selecting section that selects one arrangement pattern from the plurality kinds of arrangement patterns stored in the arrangement pattern storing section; an operational condition setting section that sets the number of printing operation times of the print section necessary to print the character string and each operational condition of a rotation angle of the rotational support section corresponding to one printing operation of the print section based on the print range and the selected arrangement pattern; a print data creating section that creates print data, which corresponds to the set number of printing operation times, where the character string is arranged within the print range along the circumference around the center of the recording medium based on the selected arrangement pattern; and a control section that repeatedly performs an operation that causes each created print data to be printed on the recording medium by one printing operation of the print section in a state that the rotation of the rotation support section is stopped, while an operation that causes the rotation support section to be rotated by the set rotation angle before a next printing operation of the print section is started according to the set operational condition.

According to the above structure, the printing apparatus comprises the rotational plate that rotatably supports the recording medium, the print section that can perform printing with a predetermined print range of the recording medium, and the print data creating section that creates print data, which corresponds to the plurality of printing operation times, where the character string to be printed is arranged within the print range along the circumference around the center of the recording medium based on the selected arrangement pattern. Based on the created print data, the printing apparatus repeatedly performs an printing operation, which prints the character string to be printed a plurality of times separately in a state that the rotation of the rotational plate is stopped, and a rotating operation, which rotates the rotational plate by a predetermined angle before a next printing operation of the print section is started according to each printing operation, by the predetermined number of times. In this way, control of simple printing operation is performed, making it possible to print the character string in a circular or arc form on the circumference around the center of the recording medium.

In the aforementioned structure, the printing apparatus may further comprise a character size setting section that sets a character size of the character string, wherein the character size setting section sets the number of printing operation times and each operational condition of the rotation angle based on the set character size, print range, and the selected arrangement pattern, and the print data creating section creates the print data such that the character string with the set character size is arranged within the print range along the circumference around the center of the recording medium.

In the aforementioned structure, the printing apparatus may further comprise a character number detecting section that detects the number of characters of the character string, wherein the character size setting section sets a character size of the character string based on the detected number of characters and the selected arrangement pattern.

The character size setting section may set the character size of the character string according to a designated character size.

The print data creating section desirably arranges the respective characters of the character string with equal distances based on the selected arrangement pattern.

The arrangement pattern storing section may store arrangement data indicating an arrangement position and an inclination with respect to each character that forms the character string arranged along the circle or arc.

The print data creating section preferably arranges the respective characters of the character string in a radial manner to the center of the recording medium based on the arrangement data corresponding to the selected arrangement pattern.

The print section may include a thermal head and moves the thermal head as pressing an ink ribbon against the recording medium supported by the rotation support section to thermally transfer ink of the ink ribbon, thereby printing the character string.

The recording medium is a data recordable optical disk having a circular hole at its center, and the character string is desirably printed along the circumference around the circular hole.

In order to attain the above object, a printing method according to a second aspect of the present invention is a printing method that prints a character string in a circular or arc shape along a circumference around a center of a rotatably supported recording medium by a plurality of times of printing operations, comprising the steps of storing a character string to be printed; selecting one arrangement pattern from a plurality kinds of arrangement patterns, being prepared in advance, for arranging the character string along a circle or arc having a predetermined length; setting the number of printing operation times necessary to print the character string and each operational condition of a rotation angle of the recording medium corresponding to one printing operation based on a printable range by one printing operation and the selected arrangement pattern; creating print data, which corresponds to the set number of printing operation times, where the character string is arranged within the print range along the circumference around the center of the recording medium based on the selected arrangement pattern; and repeatedly performing an operation that causes each created print data to be printed on the recording medium by one printing operation in a state that the rotation of the recording medium is stopped, while an operation that causes the recording medium to be rotated by the set rotation angle before a next printing operation is started according to the set operational condition.

In the aforementioned method, the printing method may further comprise the step of setting a character size of the character string based on the number of characters of the character string and the selected arrangement pattern, wherein in the operational condition setting step, the number of printing operation times and each operational condition of the rotation angle based on the set character size, the print range, and the selected arrangement pattern, in the print data creating step, the print data is created such that the character string with the set character size is arranged within the print range along the circumference around the center of the recording medium.

In the aforementioned method, the printing method may further comprise the step of designating a character size of the character string, wherein in the operational condition setting step, the number of printing operation times, and each operational condition of the rotation angle are set based on the designated character size, the print range, and the selected arrangement pattern, in the print data creating step, the print data is created such that the character string with the set character size is arranged within the print range along the circumference around the center of the recording medium.

In order to attain the above object, a program according to a third aspect of the present invention causes a computer to execute the steps of storing a character string to be printed; selecting one arrangement pattern from a plurality kinds of arrangement patterns, being prepared in advance, for arranging the character string along a circle or arc having a predetermined length; setting the number of printing operation times necessary to print the character string and each operational condition of a rotation angle of the recording medium corresponding to one printing operation based on a printable range by one printing operation and the selected arrangement pattern; creating print data, which corresponds to the set number of printing operation times, where the character string is arranged within the print range along the circumference around the center of the recording medium based on the selected arrangement pattern; and repeatedly performing such an operation that causes each created print data to be printed on the recording medium by one printing operation in a state that the rotation of the recording medium is stopped, while an operation that causes the recording medium to be rotated by the set rotation angle before a next printing operation is started according to the set operational condition.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

Figure 1:
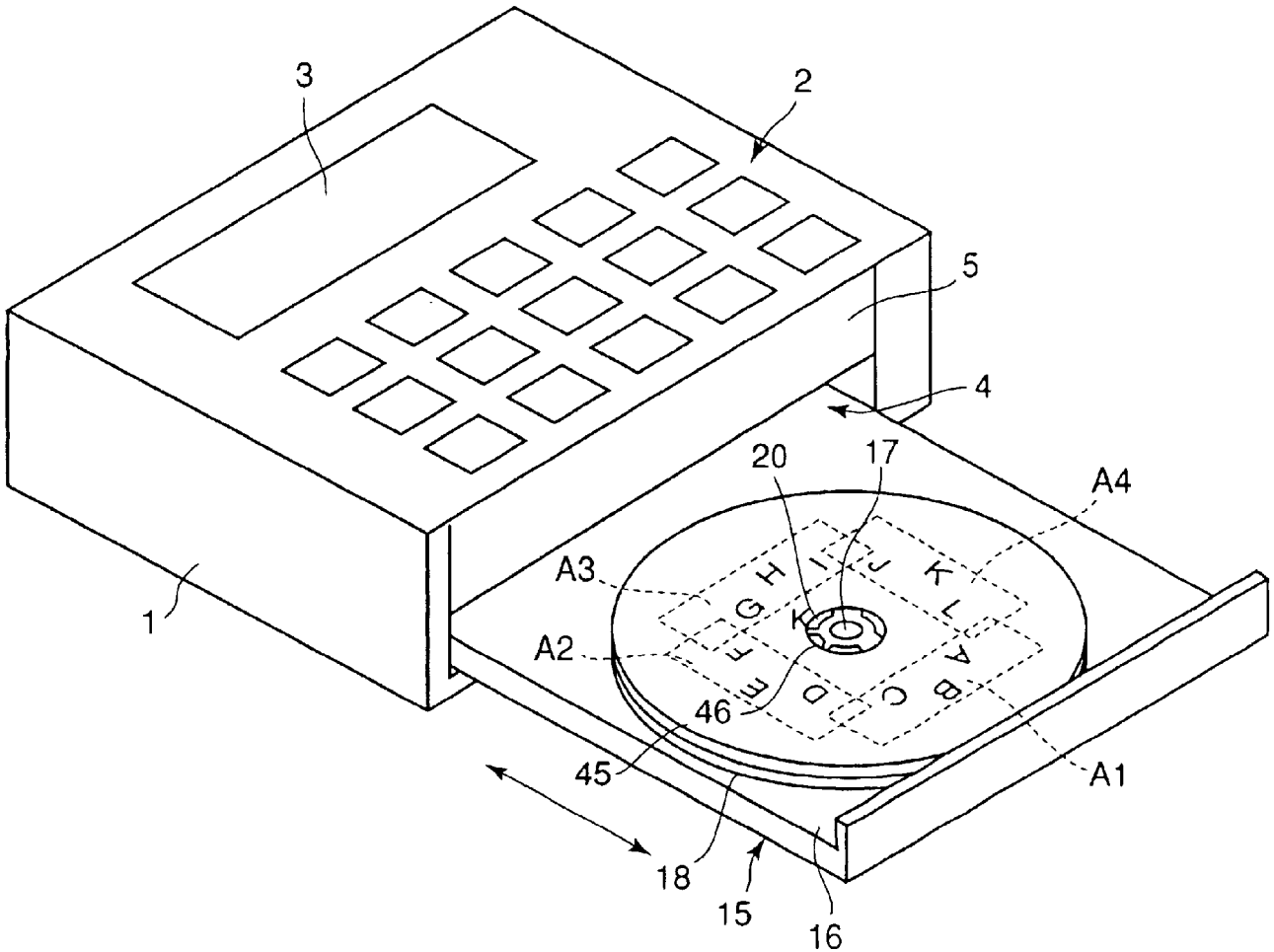
FIG. 1 is a perspective view illustrating the entirety of a printing apparatus according to an embodiment of the present invention.
Figure 2:
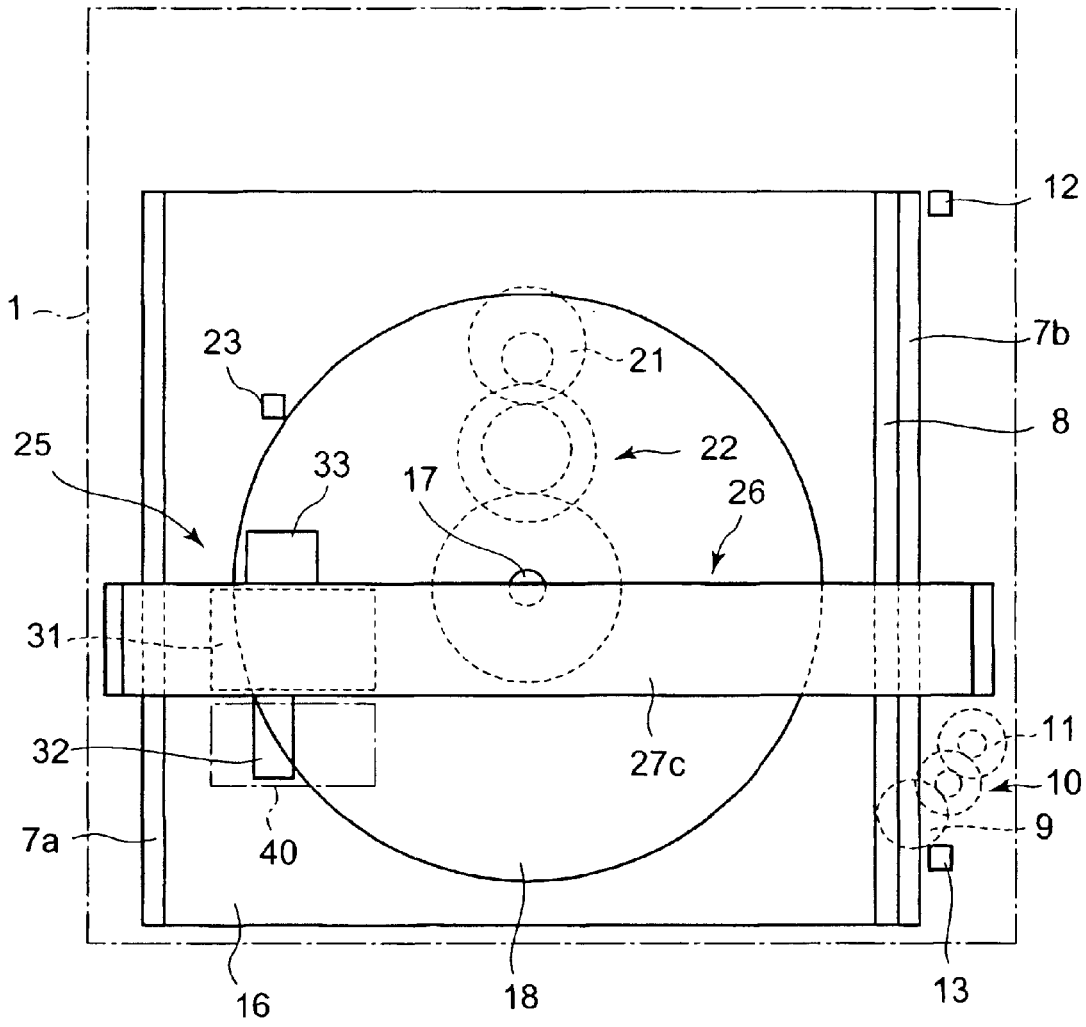
FIG. 2 is a plane view illustrating the structure of the main parts of the printing apparatus of FIG. 1.
Figure 3:
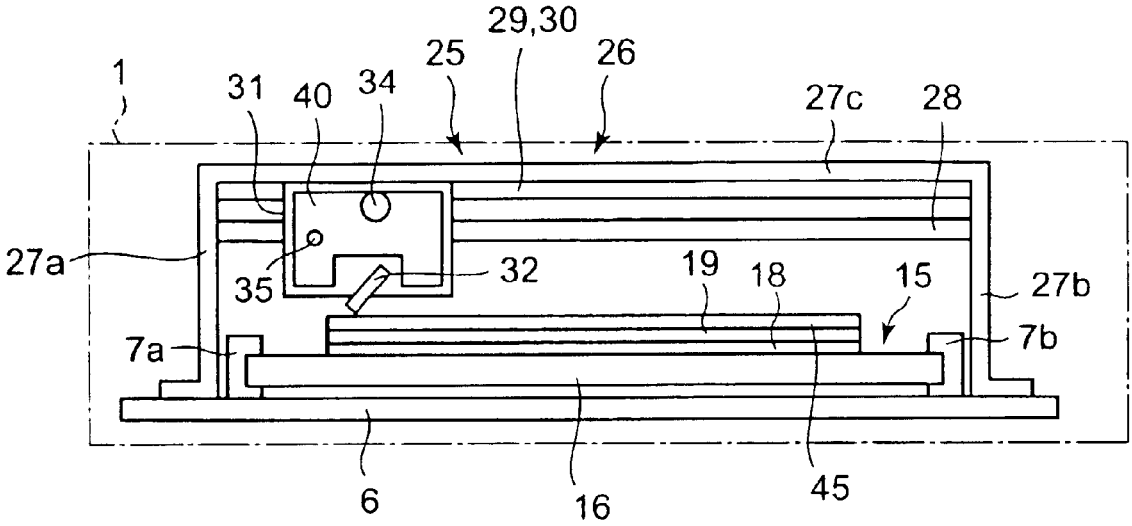
FIG. 3 is a front view illustrating the structure of the main parts of the printing apparatus of FIG. 1.

A perspective view of the entirety of the printing apparatus according to an embodiment of the present invention is illustrated in FIG. 1, and a plane view and a front view each illustrating the main parts of the printing apparatus are illustrated in FIGS. 2 and 3, respectively.

The printing apparatus includes a case 1 as an apparatus main body, and a key input section 2 and a liquid crystal display section 3 are provided on the upper surface of the case 1. An opening portion 4 is provided at the front surface of the case 1. A print cover 5, which covers a print section 25, is provided at the upper portion of the opening portion 4, and a tray 15 is provided to be drawable to the outside of the case 1 through the opening portion 4 from a containing position in the case 1.

The key input section 2 includes a character input key, which inputs a character, a mark and the like, a character size key, which inputs and sets a character size, a kanji conversion key and a non-conversion key for editing the inputted character, a cursor key, which moves a cursor displayed on the liquid crystal display section 3, a print key for executing printing of the input character string, a power key for turning ON/OFF power of the apparatus, an inject key for injecting the tray 15, and various specific functional keys. Here, the specific functional keys are operated to confirm the various input data and selection data and to provide an instruction to start the operation of the specific function. For example, as one of the specific functions, there is an arc character string print function that arranges the character string in a circular or arc shape to perform printing. The user operates the arc character string print function, which is one of the specific functions, thereby setting an operation mode that operates the arc character string print function. Moreover, the key input section 2 includes control keys, which are necessary for operations other than the above.

A base 6 is provided in the interior of the case 1, and the tray 15, which supports an optical disk (optical recording medium) 45 such as CD-R, is provided on the base 6. Moreover, in the interior of the case 1, there is provided a printer section 25 that performs printing of a predetermined character onto the surface (label surface) of the optical recording medium 45 supported by the tray 15. The printer section 25 executes printing of a title on data recorded on the recording medium in print processing to be described later. In addition, the optical recording medium 45 has a circular hole 46 at its central portion. Engaging claws 20 of a rotational plate 18 to be described later are engaged with an inner edge of the circular hole 46, so that the optical recording medium 45 is attached to the rotational plate 18.

The tray 15 has a tray main body 16, which is rectangular and plate shaped, and the rotational plate 18, which supports the optical recording medium and which is rotatable around a rotational shaft 17, is placed on the tray main body 16. A cushioning material 19 is adhered onto the surface of the rotational plate 18, and the plurality of engaging claws 20, which are engaged with the inner edge of the circular hole 46 of the recording medium 45, are projected from the surface of the rotational plate 18. The tray 15 is guided along guide rails 7*a* and 7*b*, which are provided on the base 6 at right and left positions in the case 1, to be movable to the inside and outside of the apparatus.

A rack 8 is provided on the side edge of one side of the tray main body 16, while, in the interior of the case 1, there is provided a stepping motor (tray drive motor) 11 that rotates a drive gear 9 forwardly and reversely via the drive gear 9, which meshes with the rack 8, and a gear train 10. Then, the motor 11 is driven forwardly by the operation of the inject key, so that the tray 15 placed at the containing position in the apparatus is discharged to the outside of the apparatus from the opening portion 4 formed on the front surface of the case 1, or the motor 11 is driven reversely by the operation of the inject key, so that the tray 15 placed at the outside of the apparatus is moved to the containing position in the apparatus.

Additionally, in the case 1, there is provided a position detection switch 12 that detects that the tray 15 has moved to the containing position in the apparatus. Moreover, there is provided a position detection switch 13 that detects that the tray 15 has moved to the discharge position, which is the outside of the apparatus, where the optical recording medium is attachable and detachable. The drive of the motor 11 is controlled based on signals of the position detection switches 12 and 13, so that the tray 15 is controlled to be stopped at a predetermined stop position inside or outside the case 1. These position detection switches 12 and 13 are actuated by a projection (not shown) for a switch operation provided on the tray main body 16.

The rotational plate 18 is structured such that the rotational shaft 17 is supported by the tray main body 16 to be rotatable to the tray main body 16. The rotational plate 18 uses a stepping motor (rotational plate drive motor) 21 provided on a rear surface side of the tray main body 16, and is rotatably driven anticlockwise when a driving force of the motor 21 is transmitted to the rotational shaft 17 via the gear train 22.

Additionally, in the tray main body 16, there is provided a rotation position detection switch 23 for detecting an initial position of the rotational plate 18. The detection switch 23 is actuated by a projection (not shown) for a switch operation provided on an outer periphery of the rotational plate 18.

Moreover, as mentioned above, the printer section 25 provided in the case 1 includes a thermal transfer printer, and is opposite to the rotational plate 18 of the tray 15 placed at the containing position.

The printer section 25 includes a bridge-shape printer frame 26. In the printer frame 26, leg portions 27*a* and 27*b* provided on both end portions are fixed to the base 6 in the case 1. A horizontal frame portion 27*c*, which is horizontally arranged to be bridged between the leg portions 27*a* and 27*b*, is provided to be biased to the front surface side of the case 1 from the rotation central portion of the rotational plate 18.

The printer frame 26 supports a carriage 31 mounting a thermal head 32 thereon, and forms a running path where the carriage 31 is run backwards and forwards along the rotational base 18. In the printer frame 26, a guide shaft 28, which guides the carriage 31 slidably, is provided to be parallel with a horizontal frame portion 27*c*. Moreover, a guide rail 30, which guides a rack 29 and the carriage 31, is provided along an opposite surface side to the rotational plate 18 of the horizontal frame portion 27*c*. The rack 29 is meshed with a drive gear 34 provided in the carriage 31 at the time when the carriage 31 runs. The carriage 31 uses a self-propelling system in which the carriage 31 moves backwards and forwards along the rack 29 by driving the drive gear 34 meshing with the rack 29 by a stepping motor (carriage drive motor) 33 mounted thereon.

A ribbon cartridge 40, which contains an ink ribbon for thermal transfer printing, is attached to the front side of the carriage 31, and the ribbon cartridge 40 is replaceable by opening the printer cover 5 provided at the front surface of the case 1.

Moreover, the carriage 31 is provided with a head moving mechanism, which moves the thermal head 32 to a print position and a non-print position by a cam mechanism using the motor 33 as a drive source, and a ribbon winding mechanism that drives a ribbon winding shaft 35 using the motor 33 as a driving source to wind the ink ribbon as described below.

Figure 4A:
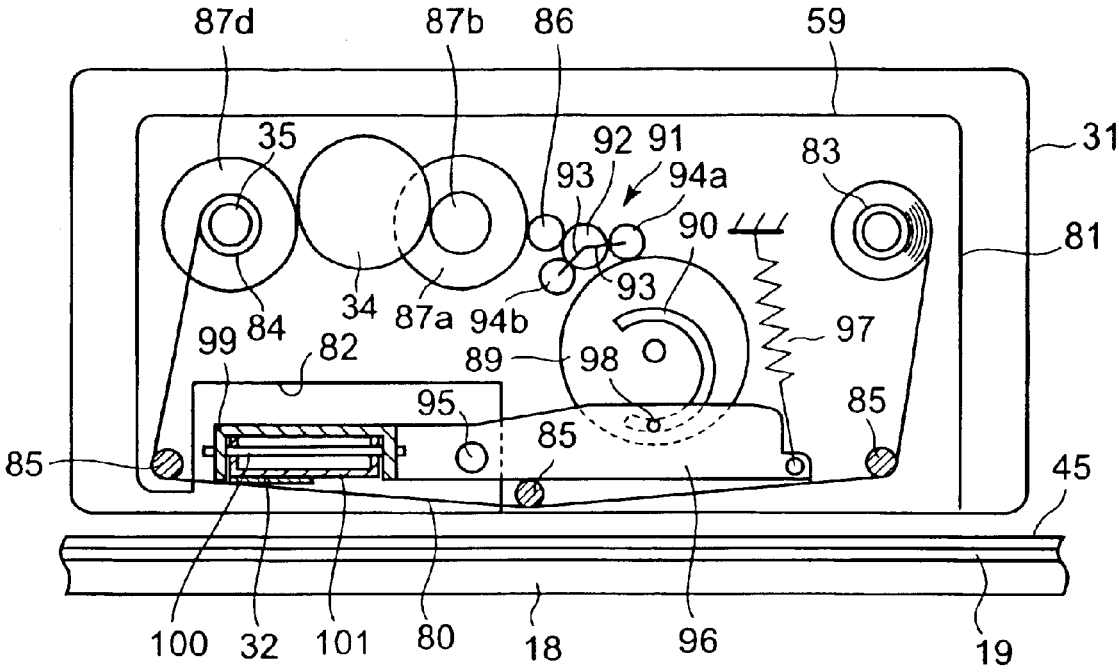
FIGS. 4A and 4B are views illustrating the structure of a printer section of the printing apparatus according to thee embodiment of the present invention.
Figure 4B:
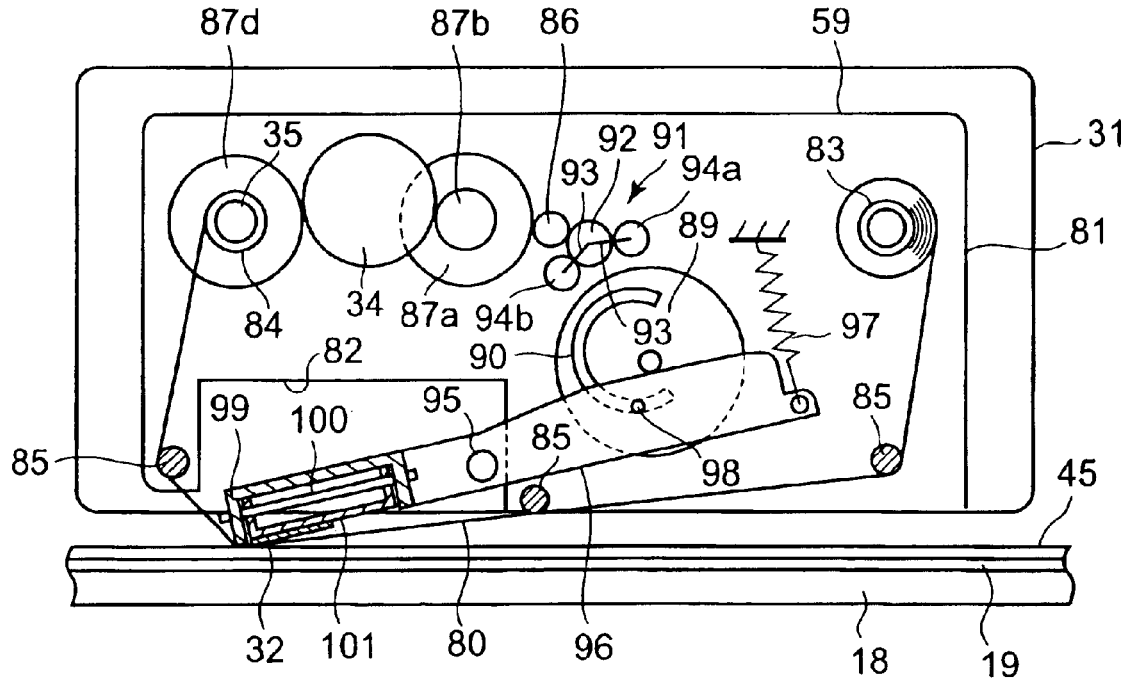

The structure of the print section 25 will be more specifically explained based on FIG. 4.

A ribbon cartridge 59, which contains an ink ribbon 80 as print consumable material, is detachably attached to a cartridge attaching surface of the front surface of the carriage 31. The ribbon cartridge 59 includes a case 81, and the case 81 has a concave portion 82 to which a head cover (not shown) is fit.

In the case 81, a ribbon supply core 83 and a ribbon winding core 84 are provided, and the ink ribbon 80 is wound around the ribbon supply core 83 in a roll shape. The ink ribbon 80, which is fed from the ribbon supply core 83, is stopped by the ribbon winding core 84 through a plurality of guide pins 85. Moreover, the ink ribbon 80 is wound around the winding core 84 sequentially in accordance with the forward and reverse rotations of the winding core 84, which is fit to the ribbon winding shaft 35. The ink ribbon 80 runs along the lower surface side of the concave portion 82 where the thermal head 32 is positioned in a state that the halfway portion of the ink ribbon 80 is exposed to the outer portion of the case 81.

In the carriage 31, there is provided an output gear 86 fixed to an output shaft of the carriage drive motor 33, and a first gear 87*a* meshes with the output gear 86. Moreover, a second gear 87*b* is coaxially provided to the first gear 87*a*, a third gear 34 meshes with the second gear 87*b*, and a fourth gear 87*d* meshes with the third gear 34.

Then, the ribbon winding shaft 35 is provided to the rotational shaft of the fourth gear 87*d* through a one-way clutch (not shown). The ribbon winding shaft 35 projects forward from the cartridge attaching surface of the carriage 31, and engages with the winding core 84 in accordance with the attachment of the ribbon cartridge 59 to the cartridge attaching surface.

The third gear 34 meshes with the rack 29 (FIG. 3), which is provided in the horizontal frame portion 27*c* along the running path of the carriage 31, in parallel with the guide shaft 28. By this meshing, the carriage 31 moves backwards and forwards along the guide shaft 28 in accordance with the forward and reverse rotations of the third gear 34.

Moreover, in the carriage 31, a cam gear 89 is provided and the cam 89 has a gear on its an outer periphery, and an arc-shape cam groove 90, which is eccentric from the center of rotation, on its side surface. Then, a swing clutch 91 is provided between the cam gear 89 and the output gear 86. The swing clutch 91 is composed of a sun gear 92 meshed with the output gear 86, and a pair of planetary gears 94*a* and 94*b* supported to be movable in a circumferential direction of the sun gear 92 through an arm 93. When the sun gear 92 rotates forwardly (clockwise rotating time), one planetary gear 94*a* meshes with the cam gear 89 and the other planetary gear 94*b* separates from the cam gear 89. On the other hand, when the sun gear 92 rotates reversely (anticlockwise rotating time), one planetary gear 94*a* separates from the cam gear 89 and the other planetary gear 94*b* meshes with the cam gear 89.

In the carriage 31, there is provided a head arm 96 that rotates up and down around a shaft 95. The head arm 96 is elastically urged anticlockwise in FIG. 4 by a spring 97 provided at the one end side in a tensioned state.

Moreover, a head arm 96 has a pin 96 at a portion close to one end, and the pin 98 is slidably inserted into the cam groove 90 of the cam gear 89. A head holder 99 is attached to an end portion of the other end side of the arm head 96. The head holder 99 is placed at the head cover (not shown) projecting to the front side of the carriage 31, and extends to the front side of the carriage 31 along the head cover. Moreover, a head base 101 is supported at the lower surface of the head holder 99 through a shaft 100, and the thermal head 32 is attached to the lower surface of the head base 101. The thermal head 32 is placed to be opposite to the opening of the lower surface of the head cover.

The thermal head 32 is pressed against the label surface, which is an opposite side to a signal recording surface of an optical disk 45 stationarily held on the rotational plate 18, which is in a stopped state. The thermal head 32 moves from the left side of FIG. 3 to the right side along the guide shaft 28 with the carriage 31 as one body, and performs printing in such a system that a predetermined image is thermally transferred onto the surface of the optical disk 45 as melting the ink of the ink ribbon during this movement. Accordingly, the rectangular area, which is fixed by a width (width of a main scanning direction) of a heating element column of the thermal head 32 and a moving distance (length of sub-scanning direction) of the thermal head 32 perpendicular to the width, reaches a print range by one printing operation.

The printer section 25 moves the carriage 31 from the left side of FIG. 3 to the right side by the forward drive of the motor 33, and moves the thermal head 32 to the print position abutting to the optical recording medium by the head moving mechanism to be held at the position. Moreover, the printer section 25 drives the ribbon winding shaft 35 by the ribbon winding mechanism to wind the ink ribbon used for thermal transfer. Moreover, the printer section 25 moves the thermal head 32 to the non-print position by the reverse drive of the motor 33 to be held at the position, and moves the carriage 31 back to the left side from the right side in FIG. 3. In the ribbon winding mechanism, there is provided a one-way clutch mechanism, and the drive of the ribbon winding shaft 35 is not performed at the time of return movement of the carriage 31.

In FIG. 1, an area A1 on the optical recording medium 45 shown by a broken line is a printable area where one printing operation of the printer section 25 is performed. In this printing apparatus, the tray 15 is contained at a predetermined containing position in the case 1, and the printing is carried out by the printer section 25 in a state that the rotational plate 18 stops. Similarly, each of areas A2 to A4 is a printable area where a printing operation of the printer section 25 is performed in a case that the rotational plate 18 rotates by a predetermined angle (for example, 90° in FIG. 1) before starting a next printing operation every one printing operation of the printer section 25 and the printing operation is repeated four times. The width of each of strip areas A1 to A4 corresponds to the width of the heating element column of the thermal head 32 and the length is a distance where the thermal head 32 moves at the print operating time.

Figure 5:
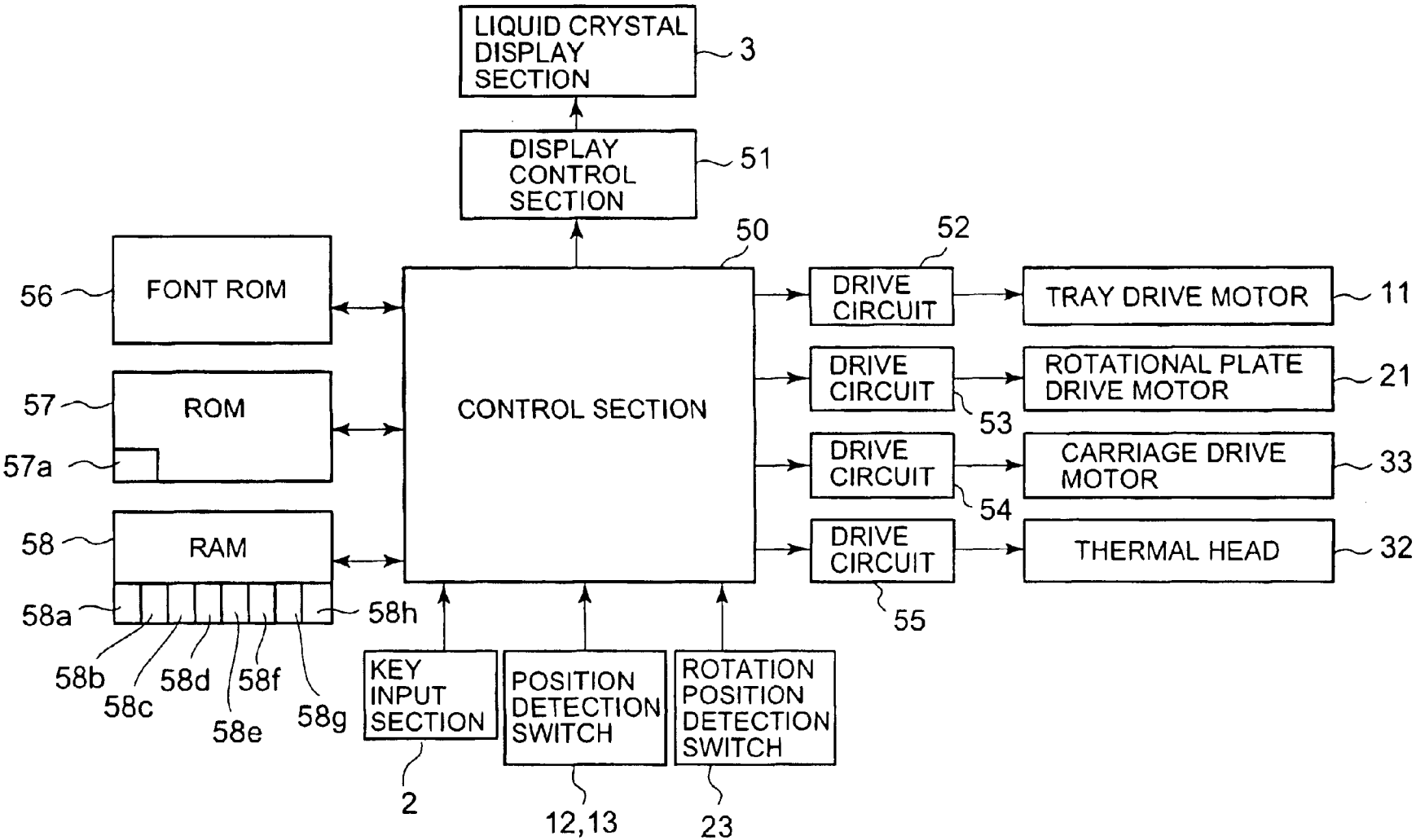
FIG. 5 is a block diagram of an electronic circuit in the printing apparatus of FIG. 1.

FIG. 5 illustrates the structure of an electronic circuit in the printing apparatus according to the present embodiment. The key input section 2, a display control section 51, driving circuits 52, 53, 54, 55, position detection switches 12, 13 of the tray 15, and the rotation position detection switch 23 of the rotational plate 18 are connected to a control section 50 included in this printing apparatus. In addition, the internal structure of the control section 50 is not specifically explained here. The control section 50 is composed of an input/output device for inputting/outputting various signals among the respective structural components as shown in FIG. 5 in addition to a CPU (Central Processing Unit) for performing various kinds of operations and control or an MPU (Micro Processing Unit), and the like.

The display control section 51 includes a display RAM for outputting display data to the liquid crystal display section 3. The driving circuits 52, 53, 54, and 55 are those that control the tray driving motor 11, the rotational plate driving motor 21, the carriage driving motor 33, and the thermal head 32, respectively.

Moreover, a font ROM 56, a ROM 57, and a RAM 58 are connected to the control section 50, and in connection with numerous characters and marks, the font ROM 56 stores display dot patterns and the print dot patterns corresponding to the character sizes of small and large. The ROM 57 stores various kinds of programs for performing processing to be described later, and includes an arrangement pattern storing section 57*a* that prestores data relating to a plurality of arrangement patterns for arranging the character string in an arc form such as a circular, semi-circular, and the like.

The aforementioned programs include, for example, a display control program, a print control program, and a print drive control program. The display control program controls the display control section 51 to be associated with code data of the character input from the key input section 2. The print control program sets a print condition based on the number of characters of the character string stored in an input buffer 58*a* to be described later and the selected arrangement pattern, and creates a print dot pattern data. The print drive control program outputs the created print dot pattern data to the terminal head 32 one column by one column. The control section 50 controls each section of the printing apparatus to perform the predetermined operation based on these programs.

Figure 6:
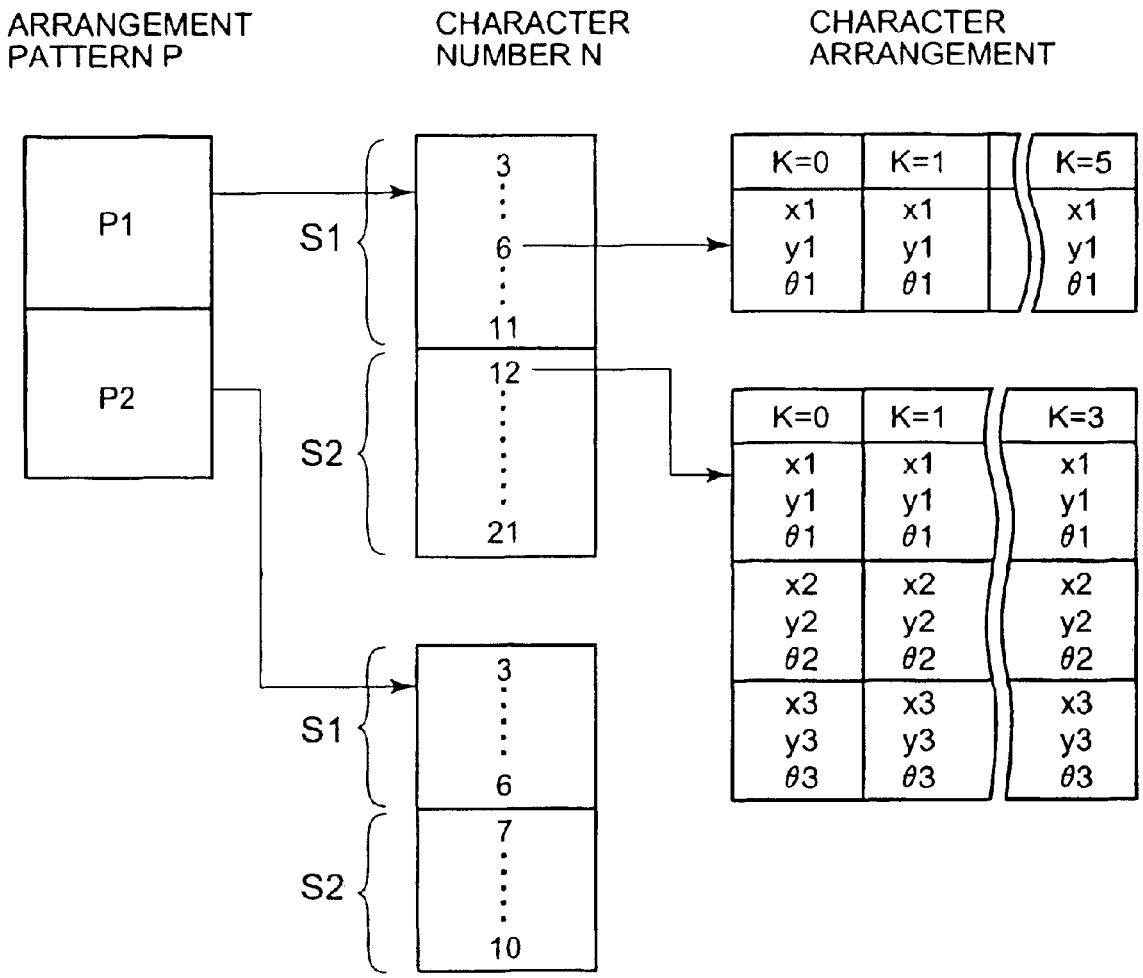
FIG. 6 is a view illustrating data stored in an arrangement pattern storage section of the electronic circuit of FIG. 5.

FIG. 6 is a view explaining data stored in the arrangement pattern storing section 57*a*. As illustrated in the figure, the arrangement pattern storing section 57*a* stores coordinates x and y, which decide the position of the character, and data of inclination è of the character (inclination angle) in connection with each character that expands to a print buffer 58*b*, to be described later, for each of the number of printing times K. Here, the aforementioned data corresponds to the number of characters that forms the character string to be printed to a circular arrangement pattern P1 and an arc (semi-circular) arrangement pattern P2, and further corresponds to the number of characters of each character string to be printed. The positional coordinates of the character are decided such that the distance between the respective characters becomes equal when the character string is arranged in the circular or arc form. Moreover, the inclination angle è is set such that the respective characters arranged in the circular or arc shape become radial to the center of the optical recording medium.

Regarding the arrangement patterns, the circular arrangement pattern P1 is one that arranges the respective characters, which forms the character string with a full circle, and the arc arrangement pattern P2 is one that arranges the respective characters, which forms the character string with a semi-circle. The arrangement patterns P1 and P2 are fixed to have a predetermined circumferential length and a predetermined arc length, respectively. The number of character sizes of the printing characters is decided to be two kinds of small and large, and for example, a large size S1 corresponds to about 40 points and a small size S2 corresponds to about 28 points. The maximum number of characters of the large size S1, which can be arranged in the circular arrangement pattern P1, is 11, and similarly, the maximum number of characters of the small size S2 is 21. Moreover, the maximum number of characters of the large size S1, which can be arranged in the circular arrangement pattern P2, is 6, and similarly, the maximum number of characters of the small size S2 is 10. While, the minimum number of characters, which can be printed in the circular arrangement pattern P1, is 3, and the minimum number of characters, which can be printed in the circular arrangement pattern P2, is 2.

When the arrangement pattern is circular and the number of characters is 3 to 11, the character size is set to the large size S1 as explained later, and the printing operation is performed six times by the printer section 25. For example, as illustrated in FIG. 6, when the number of characters is 6, the characters are printed one character by one character in accordance with six printing operation times, and the arrangement position and inclination angle of the character are decided. Further, when the arrangement pattern is circular and the number of characters is 12 to 21, the character size is set to the small size S2 as explained later, and the printing operation is performed four times by the printer section 25. For example, as illustrated in FIG. 6, when the number of characters is 12, the characters are printed three characters by three characters in accordance with four printing operation times and the arrangement position and inclination angle of the character are decided.

Moreover, when the arrangement pattern is arc (semi-circular) and the number of characters is 2 to 6, the character size is set to the large size S1 and the printing is dividedly performed three times by the printer section 25. While, when the number of characters is 7 to 10, the character size is set to the small size S2 and the printing is dividedly performed two times by the printer section 25.

Figure 7A:
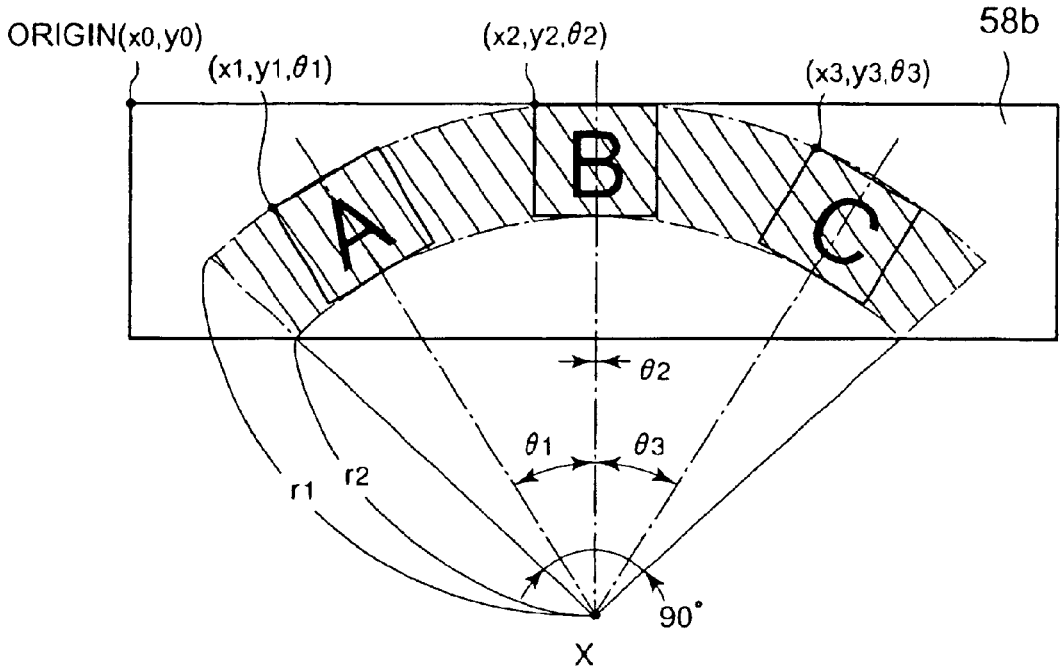
FIGS. 7A and 7B are views illustrating a state that print data of a character string is arranged in an arc shape.

FIG. 7A schematically shows the state in which the character string corresponding to one printing operation is expanded to the print buffer 58*b* when the character size is set to the small size. Moreover, the arrangement of the character string to be printed on the label surface of the optical recording medium is understood from FIG. 7A. As illustrated in FIG. 7A, in connection with an origin (x0, y0), the first character is inclined by an angle è1 and expanded with reference to upper left coordinates (x1, y1) based on data stored in the arrangement pattern storing section 57*a*. The second and third characters are similarly expanded to the decided coordinate values by the decided inclination angle. This printing apparatus can perform printing in the respective rectangular ranges illustrated by A1 to A4 in FIG. 1 if all in the print buffer 58*a* are printed. However, when the character string is printed according to the circular or arc arrangement pattern, character pattern data is partially expanded to the print buffer 58*b*. Namely, the diagonally shaded area in FIG. 7A becomes an effective print area in connection with the circular or arc arrangement pattern, and printing is actually performed in this area. A spread angle of 90° is illustrated as in FIG. 7A. Accordingly, such print data is printed four times as rotating the optical recording medium by 90°, thereby making it possible to print the character string in a circular shape, and such printing is performed two times, thereby making it possible to print the character string in an arc (semi-circular) shape.

Figure 7B:
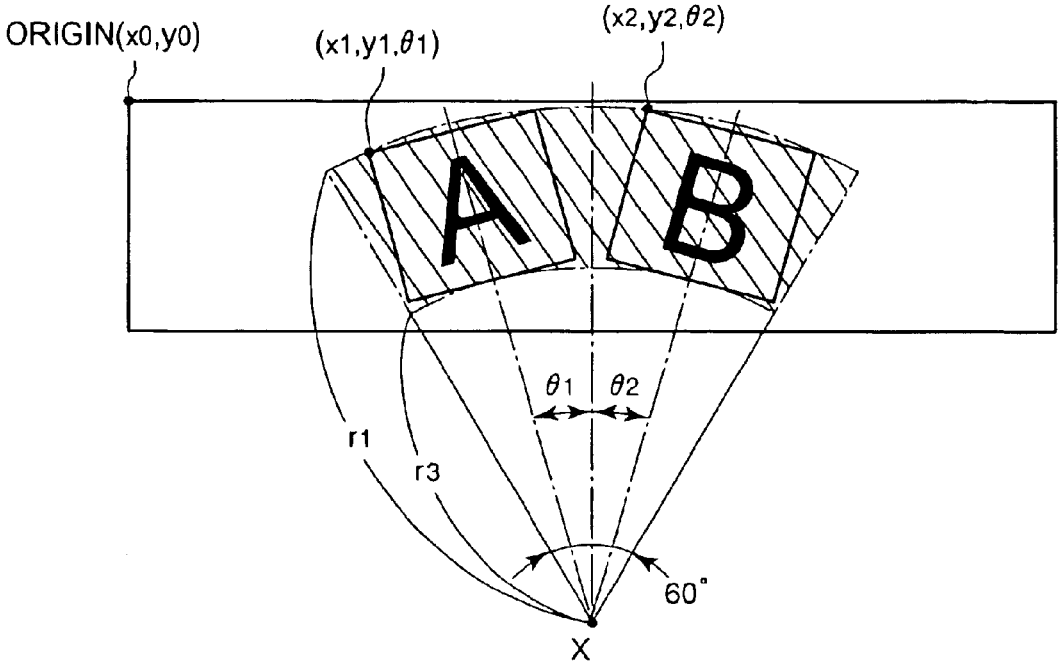

Similarly, FIG. 7B illustrates a case in which the character size is set to the large size. the first character is inclined by an angle è1 and expanded with reference to upper left coordinates (x1, y1) based on data stored in the arrangement pattern storing section 57*a*, and afterward the second character also expanded to the decided coordinate values by the decided inclination angle. An actual print area, which is diagonally shaded, has a spread angle of 60°. Accordingly, such print data is printed six times as rotating the optical recording medium by 60°, thereby making it possible to print the character string in a circular shape, and such printing is performed three times, thereby making it possible to print the character string in an arc (semi-circular) shape.

In FIGS. 7A and 7B, X denotes the center of the rotation of the rotational plate 18 and the center of the optical recording medium. It is assumed that r1, r2, and r3 are 45 mm, 35 mm, and 30 mm, respectively.

Backing to FIG. 5, RAM 58 includes an input buffer 58*a*, a print buffer 58*b*, a selection pattern memory 58*c*, a character number memory 58*d*, a character size memory 58*e*, a necessary printing operation time memory 58*f*, a rotation angle memory 58*g*, and an execution print time memory 58*h*. Here, the input buffer 58*a* stores the input character string, and print data of the character to be printed for each printing operation is expanded to the print buffer 58*b*. The selection pattern memory 58*c* stores the kinds of the selected arrangement patterns P (circular form is P1, and arc form is P2), the character number memory 58*d* stores the number of characters N of the input character string, and the character size memory 58*e* stores the character sizes S (large size S1 and small size S2) of the character. Moreover, the necessary printing operation time memory 58*f* stores the necessary number of printing operations K, the rotation angle memory 58*g* stores the rotation angle R of the rotational plate 18, and the execution print time memory 58*h* stores the number of execution print times H.

Figure 8:
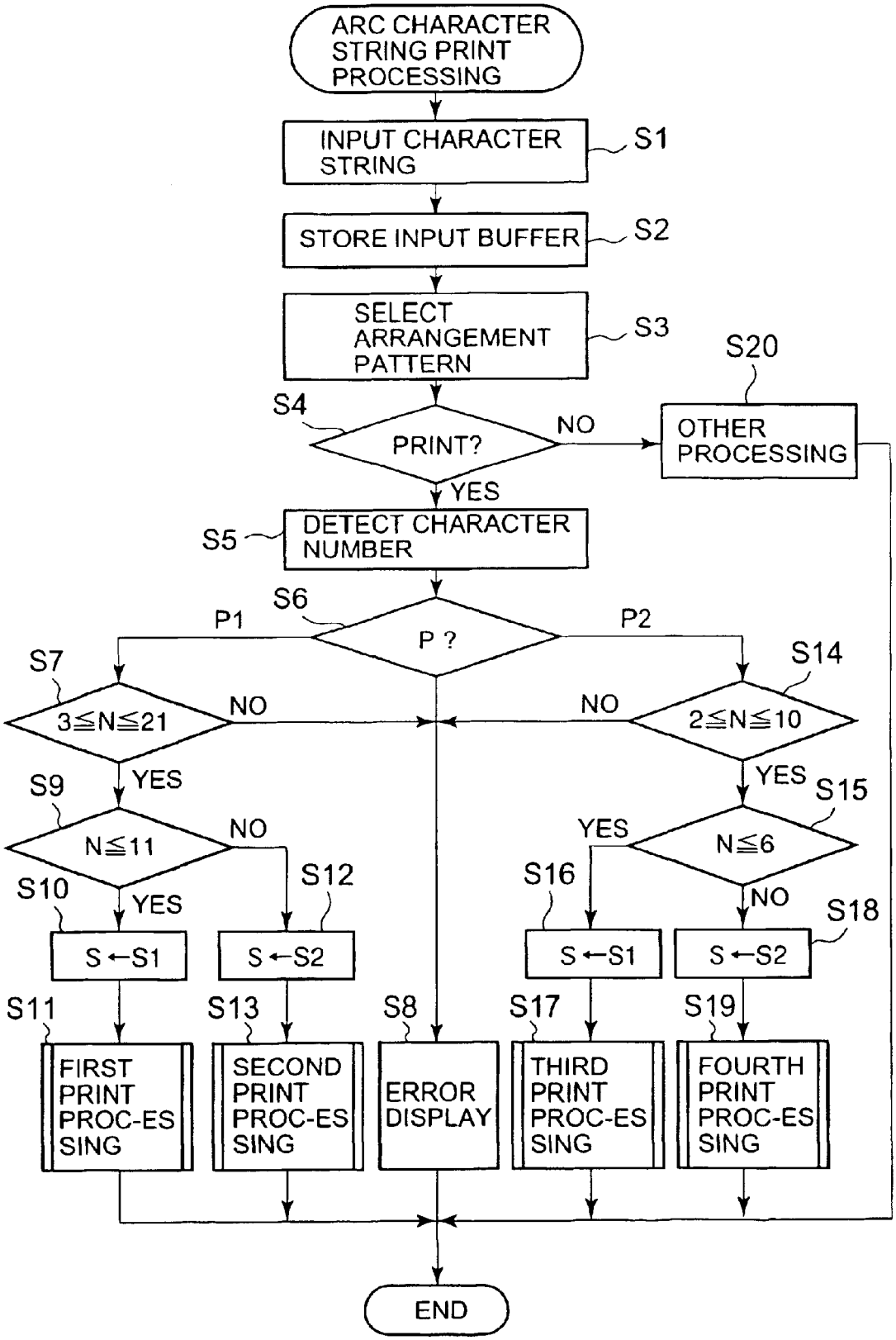
FIG. 8 is a flowchart illustrating the entirety of print processing of the printing apparatus according to the embodiment of the present invention.
Figure 9:
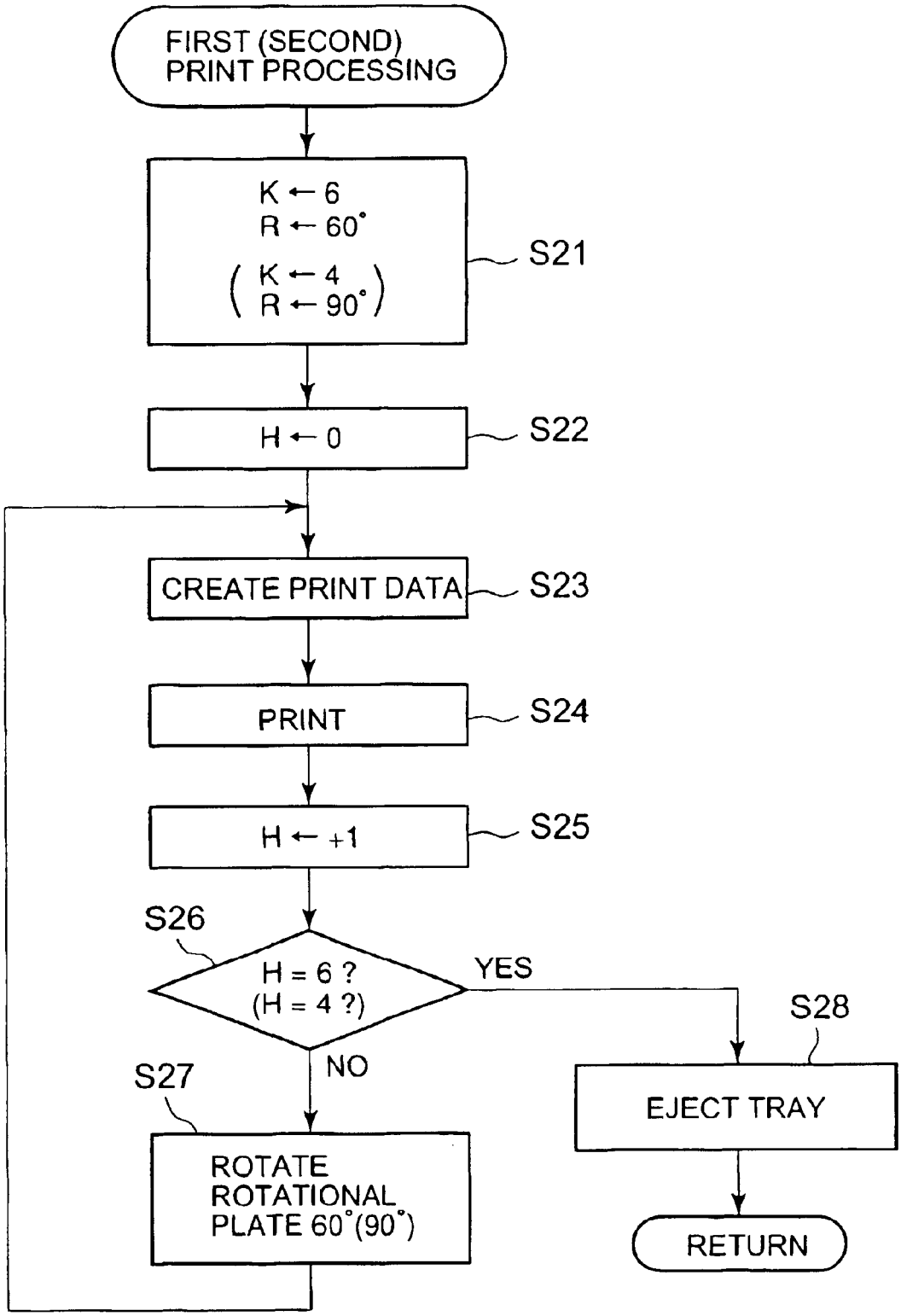
FIG. 9 is a flowchart illustrating first and second print processing according to the embodiment of the present invention.
Figure 10:
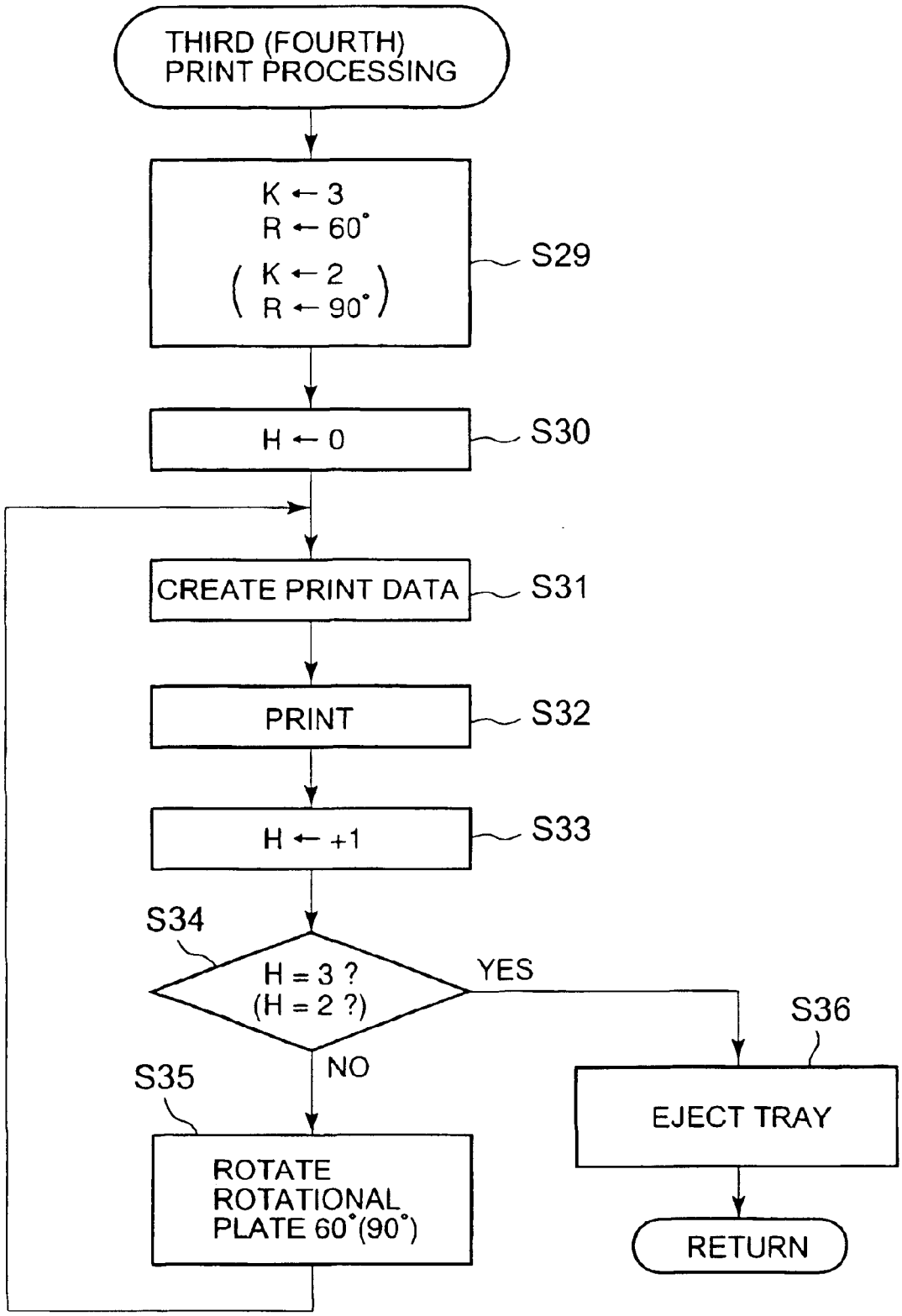
FIG. 10 is a flowchart illustrating third and fourth print processing according to the embodiment of the present invention.

FIGS. 8 to 10 are flowcharts each illustrating the arc character string print processing of the printing apparatus.

Before explaining the arc character string print processing of the printing apparatus illustrated in FIGS. 8 to 10, printing apparatus setting modes will be briefly explained. The printing apparatus can be set to a general print mode and an arc character string print mode to be described later, and the general print mode is commonly set.

In the general print mode, when the user inputs a character string by the character input key of the key input section 2, sets a character size by the character size key, and operates the print key to instruct to execute printing, the printer section 25 is actuated, so that the input character string is linearly arranged in one area A1 shown in FIG. 1 to be printed.

When the user operates the arc character string print key of the key input section 2, the printing apparatus is set to the arc character string print mode, and the processing flow of the arc character string shown in FIGS. 8 to 10 is started.

First of all, when the user inputs the character string to be printed onto the label surface of the optical recording medium from the key input section 2 (step S1), the character string is stored in the input buffer 58*a* (step S2). Next, the user selects a character string arrangement pattern from two arrangement patterns P1 and P2 of circular and arc forms. The selection of arrangement pattern is performed on the selection screen on the liquid crystal display section 3. On this selection screen, selective character string arrangement patterns, for example, two arrangement patterns P1 and P2 of circular and arc forms are displayed by icons representing a full circle and a semi-circle, respectively. The user points out an icon corresponding to a predetermined arrangement pattern by a cursor to perform a selective operation on the selection screen. Data of the kind of the selected arrangement pattern is stored in the selection pattern memory 58*c*

(step S3). Here, when printing is instructed by the user (step S4), the number of characters of the character string stored in the input buffer 58*a* is detected and the number of characters N is stored in the character number memory 58*d* (step S5). Next, the kind of the selected arrangement pattern P is judged (step S6). When the kind of the selected arrangement pattern is a circular pattern P1, it is judged whether or not the number of characters N is 3 or more and 21 or less (step S7), and when the number of characters N is not in the above range (step S7: NO), an error is displayed as an inappropriate printing (step S8) and processing ends. When the number of characters N is in the above range (step S7: YES), it is judged whether the number of characters is 11 or less (step S9). When the number of characters is 11 or less (step S9: YES), the large size S1 is set to the character size memory 58*e* (step S10) and first print processing is performed (step S11). When the number of characters is not 11 or less (step S9: NO), the small size S2 is set to the character size memory 58*e* (step S12) and second print processing is performed (step S13).

Moreover, when the kind of the arrangement pattern selected in step S6 is an arc pattern P2, it is judged whether or not the number of characters N is 2 or more and 10 or less (step S14), and when the number of characters N is not in the above range (step S14: NO), an error is displayed as an inappropriate printing (step S8) and processing ends. When the number of characters N is in the above range (step S7: YES), it is judged whether the number of characters is 6 or less (step S15). When the number of characters is 6 or less (step S15: YES), the large size S1 is set to the character size memory 58*e* (step S16) and third print processing is performed (step S17). When the number of characters is not 6 or less (step S15:NO), the small size S2 is set to the character size memory 58*e* (step S18) and fourth print processing is performed (step S19). Further, when other processing is instructed in step S4, the processing is performed (step S20).

FIG. 9 illustrates first and second print processing. For simplification, the parts of second print processing different from those of the first print processing are described in parentheses. A value 6 as the necessary printing operation time K is set to the necessary printing operation time memory 58*f* (4 in the case of the second print processing), and 60° as a rotation angle R is set to the rotation angle memory 58*g* (90° in the case of the second print processing) (step S21). Next, the execution print time H of the execution print time memory 58*h* is cleared to zero (step S22). Moreover, the arrangement positions (x, y) of the character of Hth printing and data of the inclination angle è, which correspond to the selected arrangement pattern P1 stored in the selection pattern memory 58*c* (P2 in the case of the second print processing) and the character number N stored in the character number memory 58*d*, are read from the arrangement pattern storing section 57*a*. Dot pattern data of the character with large size S1 (small size S2 in the case of the second print processing) read from the font ROM 56 is expanded to the print buffer 58*b* to create print data based on the above-read data (step S23). The created print data is transferred to the thermal head 32 one dot line by one dot line, and the thermal head 32 is driven as being moved by the carriage 31 to perform printing to the optical recording medium (step S24).

In this printing apparatus, in FIG. 2, printing is performed when the carriage 31 moves from the left side to the right side. The print direction corresponds to the direction which is from the right side to the left side in FIG. 7A. For this reason, according to this printing apparatus, when print data of the character string as illustrated in FIG. 7A is expanded to the print buffer 58*b*, print data is transferred to the thermal head 32 one dot line by one dot line from the right side to the left side in FIG. 7A. In other words, the print data of the character string is read in a reverse order, so that printing is performed from a character C of the last portion. Additionally, in FIG. 2, the printer section 25 can be structured to perform printing when the carriage 25 moves from the right side to the left side. In this case, for example, print data of the character string as illustrated in FIG. 7A is read in a letter sequence order, so that printing is performed from a top character A in order.

When printing ends, the execution print time data H of the execution print time memory 58*h* is incremented (step S25), and it is judged whether the value is 6 (4 in the case of the second print processing) (step S26). When the execution print time data H is not 6 (4 in the case of the second print processing) (step S26:NO), the rotational plate driving motor 21 is rotated by 60° (90° in the case of the second print processing) to make a next print position of the optical recording medium to correspond to the printer section 25 (step S27). Thereafter, the processing flow returns to step S23 to create print data for a next printing operation and to execute the following print operations.

In this way, the aforementioned printing operation and rotating operation are repeatedly executed until it is judged that the execution print time data H is 6 (4 in the case of the second print processing) in step S26. This makes it possible to print the character string circularly on the circumference around the circular hole of the optical recording medium. When it is judged that the value of the execution print time data H reaches 6 (4 in the case of the second print processing) (step S26:YES), the tray movement motor 11 is driven, so that the tray 15 is ejected and print processing is ended (step S28, END).

FIG. 10 illustrates third and fourth print processing. For simplification, the parts of fourth print processing different from those of the third print processing are described in parentheses. A value 3 as the necessary printing operation time K is set to the necessary printing operation time memory 58*f* (2 in the case of the fourth print processing), and 60° as rotation angle R is set to the rotation angle memory 58*g* (90° in the case of the fourth print processing) (step S29). Next, the execution print time H of the execution print time memory 58*h* is cleared to zero (step S30). Moreover, the arrangement position of the character of Hth printing and data of the inclination angle è, which correspond to the selected arrangement pattern P1 stored in the selection pattern memory 58*c* (P2 in the case of the fourth print processing) and the character number N stored in the character number memory 58*d*, are read from the arrangement pattern storing section 57*a*. Dot pattern data of the character with large size S1 (small size S2 in the case of the fourth print processing) read from the font ROM 56 is expanded to the print buffer 58*b* to create print data based on the above-read data (step S31). The created print data is transferred to the thermal head 32 one dot line by one dot line, and the thermal head 32 is driven as being moved by the carriage 31 to perform printing to the optical recording medium (step S32).

When printing ends, the execution print time data H of the execution print time memory 58*h* is incremented (step S33), and it is judged whether the value is 3 (2 in the case of the fourth print processing) (step S34). When the execution print time data H is not 3 (2 in the case of the fourth print processing) (step S34:NO), the rotational plate driving motor 21 is rotated by 60° (90° in the case of the fourth print processing) to make a next print position of the optical recording medium to correspond to the printer section 25 (step S35). Thereafter, the processing flow returns to step S31 to create print data for a next printing operation and to execute the following print operations.

In this way, the aforementioned printing operation and rotating operation are repeatedly executed until it is judged that the execution print time data H is 3 (2 in the case of the fourth print processing) in step S34. This makes it possible to print the character string in an arc form on the circumference around the circular hole of the optical recording medium. When it is judged that the value of the execution print time data H reaches 3 (2 in the case of the fourth print processing) (step S34:YES), the tray movement motor 11 is driven, so that the tray 15 is ejected and print processing is ended (step S36, END).

Figure 11:
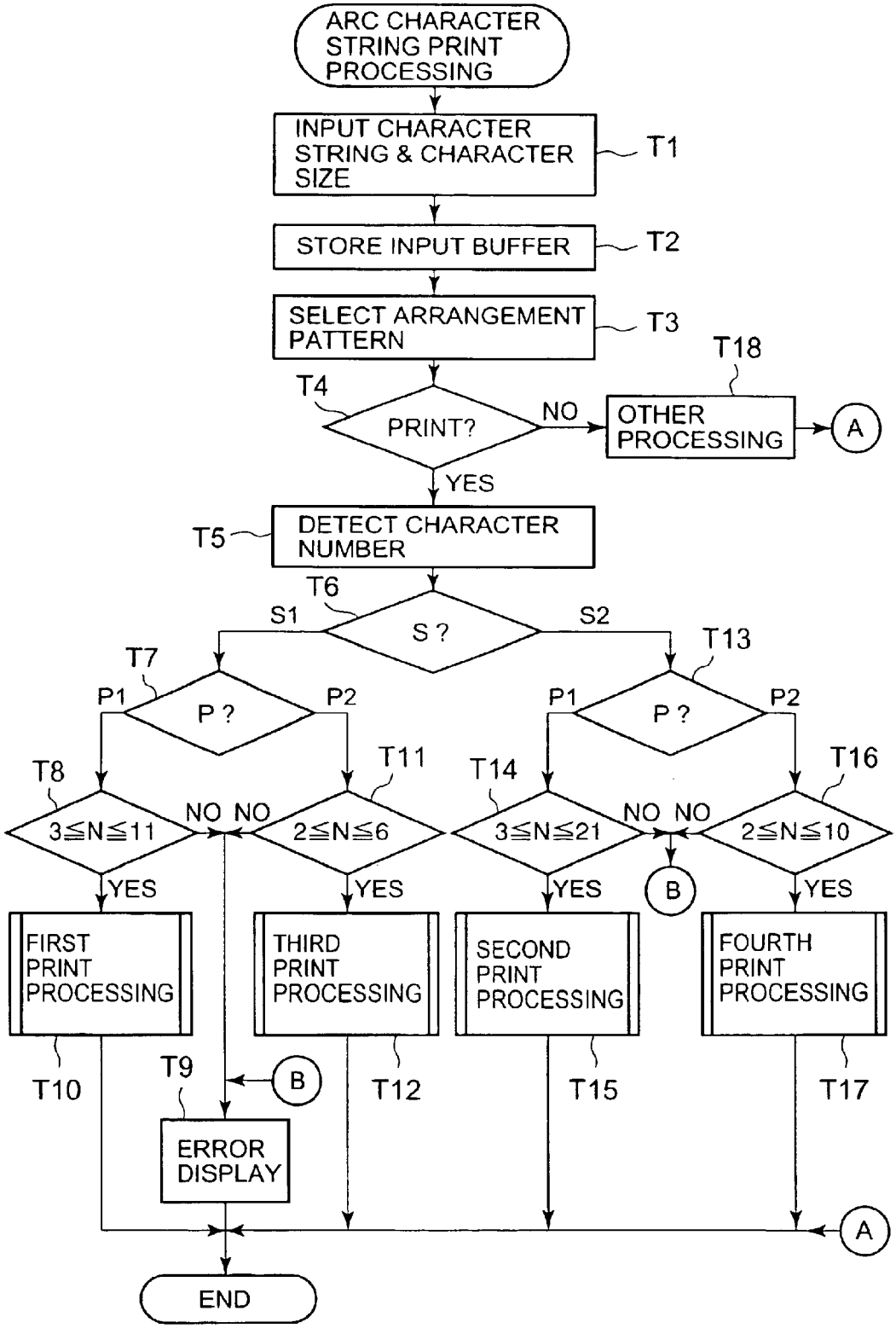
FIG. 11 is a flowchart illustrating the entirety of print processing according to another embodiment of the present invention.

Next, FIG. 11 illustrates print processing according to another embodiment of the present invention. The aforementioned embodiment has explained that the character size is decided according to the arrangement pattern and the number of characters, however, in this embodiment, the character size is set together with the character string at the inputting time.

When the user input a character string to be printed onto the label surface of the optical recording medium and the character size of large size S1 or small size S2 are input from the key input section 2 (step T1), the relevant character string and the character size are stored in the input buffer 58*a* (step T2). Next, when the user selects an arrangement pattern of the character string on the liquid crystal display section 3, data of the kind of the selected arrangement pattern is stored in the arrangement pattern memory 58*c* (step T3). Then, when printing is instructed by the user (step T4), the number of characters of the character string stored in the input buffer 58*a* is detected and the number of characters N is stored in the character number memory 58*d* (step T5). Next, the input character size S is judged (step T6). When the character size is the large size S1, the kind of the selected arrangement pattern P is judged (step T7), and when the kind of the selected arrangement pattern is a circular pattern P1, it is judged whether the number of characters N is 11 or less (step T8). When the number of characters N is not in the above range (step T8:NO), an error is displayed as an inappropriate printing (step T9) and processing ends. When the number of characters N is in the above range (step T8:YES), first print processing illustrated in FIG. 9 is performed (step T10).

Moreover, when the kind of the arrangement pattern selected in step T7 is an arc pattern P2, it is judged whether or not the number of characters N is 2 or more and 6 or less (step T11). When the number of characters N is not in the above range (step T11: NO), an error is displayed as an inappropriate printing (step T9) and processing ends. When the number of characters N is in the above range (step T11: YES), third print processing shown in FIG. 10 is performed (step T12). Moreover, when it is judged that the input character size is small size S in step T6, the kind of the arrangement pattern P selected in step T3 is judged (step T13). When the kind of the selected arrangement pattern is a circular pattern P1, it is judged whether or not the number of characters N is 3 or more and 21 or less (step T14). When the number of characters N is not in the above range (step T14:NO), an error is displayed as an inappropriate printing (step T9) and processing ends. When the number of characters N is in the above range (step T14: YES), second print processing illustrated in FIG. 9 is performed (step T15).

Moreover, when the kind of the arrangement pattern selected in step T13 is an arc pattern P2, it is judged whether or not the number of characters N is 2 or more and 10 or less (step T16). When the number of characters N is not in the above range (step T16: NO), an error is displayed as an inappropriate printing (step T9) and processing ends. When the number of characters N is in the above range (step T16:YES), fourth print processing shown in FIG. 10 is performed (step T17). Moreover, when other processing is instructed in step T4, the processing is performed (step T18).

As explained above, the printing apparatus according to the above embodiment includes the rotational plate 18 that rotatably supports the recording medium and the printer section 25 that can perform printing within a predetermined print range of the recording medium. Moreover, the printing apparatus arranges the character strings to be printed within the aforementioned print range along an inner periphery of the recording medium based on the selected arrangement pattern, and creates print data corresponding to the plurality of print operating times. Based on this print data, the printing apparatus stops the rotation of the rotational plate 18 to make the recording medium stationary, and repeats, by predetermined times, the printing operation, which dividedly prints the character string to be printed a plurality of times, and the rotating operation, which causes the rotational plate 18 to be rotated by a predetermined angle before starting a next printing operation according to each printing operation. In this way, control of the simple printing operation is performed, making it possible to print the character string in a circular or arc form on the circumference around the center of the recording medium.

The present invention is not limited to the above embodiments and the application and modifications may be arbitrarily made. For example, the above embodiments have explained that data stored in the arrangement pattern storing section 57*a* is print position data that is made to correspond to the circular arrangement pattern P1 and the arc (semicircular) arrangement pattern P2. However, the selective arrangement pattern is arbitrarily used without being limited to the aforementioned arrangement patterns P1 and P2. For example, since print data illustrated in FIG. 7A is the spread angle of 90°, such print data is printed three times as rotating the optical recording medium by 90°, thereby making it possible to print such print data in an arc shape with a central angle of 270°. Similarly, since print data illustrated in FIG. 7B is the spread angle of 60°, such print data is printed two times as rotating the optical recording medium by 60°, thereby making it possible to print such print data in an arc shape with a central angle of 120°, and such print data is printed four times in the same manner, thereby making it possible to print such print data in an arc shape with a central angle of 240°. Furthermore, the inclination angle è of data stored in the arrangement pattern storing section 57*a* can be arbitrarily set within the range where the adjacent characters are not overlapped. Accordingly, the spread angle, which indicates a printable range by one printing operation, is not limited to 90° or 60°, it is possible to print such print data in a circular shape with an arbitrary central angle in principle.

The aforementioned embodiments have explained that the number of character sizes of the printing characters is decided to be two kinds of small and large and the large size S1 corresponding to about 40 points and the small size S2 corresponding to about 28 points can be set. However, the kind of the printing characters and the number of points of the character are not limited to the above example, and they may be arbitrarily set within the practical range. Data stored in the arrangement pattern storing section 57*a* may be set to be made to correspond to the appropriate arrangement pattern based on the character size to be set.

The aforementioned embodiments have explained the optical recording medium as an example in connection with the recoding medium to be printed. For example, optical recording media such as MD, CD-ROM, CD-RW, DVD-ROM, DVD-R, DVD-RAM, DVD-RW, DVD+RW, and the like may be used in addition to a magnetic disk such as a flexible disk and the like, an optical magnetic disk such as an MO disk and like, and CD-R exemplified as an optical disk. Moreover, the diameter of the optical recording medium is not limited to 12 cm, and the optical recording medium with the other diameter such as 8 cm may be used.

The above embodiments have explained that the programs for executing the respective operations are stored on ROM 57 of the printing apparatus. However, the storage medium of the programs is not limited to this, and any media may be used. For example, other storage media such as an IC card, a memory card, and the like may be used. Moreover, for example, a personal computer is connected to the printing apparatus, and the printing apparatus may be controlled via this personal computer. In this case, the above program may be stored on the hard disk of the personal computer or the storage media for the external storage device such as a floppy disk, CD-ROM, DVD-ROM, and the like. Or, the relevant program is carried on a computer-operable carrier wave to be supplied to the personal computer, and the printing apparatus may be thereby controlled.

The aforementioned embodiments have explained the printer section 25 as the printer of a thermal transfer system, however, the printer system is not limited to this and any system may be used, and, for example, this may be structured by the printer of an ink jet system.

As explained above, according to the present invention, it is possible to provide a small-sized and low-cost printing apparatus with a simple apparatus structure and printing method that can easily print a character string in a circular or arc shape on a circumference around the center of a recording medium such as an optical disk and the like.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2002-189723 filed on Jun. 28, 2002 and including specification, claims, drawings and summary. The disclosure of the above Japanese Patent Application is incorporated herein by reference in its entirety.

What is claimed is:

1. A printing apparatus comprising:

a rotational support section that rotatably supports a recording medium;

a character string storing section that stores an input character string;

a print section that prints the character string within a predetermined print range of the recording medium supported by said rotational support section by one printing operation;

an arrangement pattern storing section, being prepared in advance, that stores a plurality of kinds of arrangement patterns to arrange the character string along a circle or arc having a predetermined length;

an arrangement pattern selecting section that selects one arrangement pattern from the plurality of kinds of arrangement patterns stored in said arrangement pattern storing section;

an operational condition setting section that sets the number of printing operation times of said print section necessary to print the character string and each operational condition of a rotation angle of said rotational support section corresponding to one printing operation of said print section based on the print range and the selected arrangement pattern;

a print data creating section that creates print data, which corresponds to the set number of printing operation times, where the character string is arranged within the print range along the circumference around the center of the recording medium based on the selected arrangement pattern; and a control section that repeatedly alternately performs: (i) an operation that causes each created print data to be printed on the recording medium by one printing operation of said print section in a state that the rotation of said rotation support section is stopped, and (ii) an operation that causes said rotation support section to be rotated by the set rotation angle before a next printing operation of said print section is started according to the set operational condition.

2. The printing apparatus according to claim 1, further comprising a character size setting section that sets a character size of the character string, wherein said character size setting section sets the number of printing operation times and each operational condition of the rotation angle based on the set character size, print range, and the selected arrangement pattern, and said print data creating section creates the print data such that the character string with the set character size is arranged within the print range along the circumference around the center of the recording medium.

3. The printing apparatus according to claim 2, further comprising a character number detecting section that detects the number of characters of the character string, wherein said character size setting section sets a character size of the character string based on the detected number of characters and the selected arrangement pattern.

4. The printing apparatus according to claim 2, wherein said character size setting section sets the character size of the character string according to a designated character size.

5. The printing apparatus according to claim 2, wherein said print data creating section arranges the respective characters of the character string with equal distances based on the selected arrangement pattern.

6. The printing apparatus according to claim 1, wherein said arrangement pattern storing section stores arrangement data indicating an arrangement position and an inclination with respect to each character that forms the character string arranged along the circle or arc.

7. The printing apparatus according to claim 6, wherein said print data creating section arranges the respective characters of the character string in a radial manner to the center of the recording medium based on the arrangement data corresponding to the selected arrangement pattern.

8. The printing apparatus according to claim 1, wherein said print section includes a thermal head and moves the thermal head as pressing an ink ribbon against the recording medium supported by said rotation support section to thermally transfer ink of the ink ribbon, thereby printing the character string.

9. The printing apparatus according to claim 1, wherein the recording medium is a data recordable optical disk having a circular hole at its center, and the character string is printed along the circumference around the circular hole.

10. A printing method that prints a character string in a circular or arc shape along a circumference around a center of a rotatably supported recording medium by a plurality of times of printing operations, comprising the steps of:

storing a character string to be printed;

selecting one arrangement pattern from a plurality kinds of arrangement patterns, being prepared in advance, for arranging the character string along a circle or arc having a predetermined length;

setting the number of printing operation times necessary to print the character string and each operational condition of a rotation angle of the recording medium corresponding to one printing operation based on a printable range by one printing operation and the selected arrangement pattern;

creating print data, which corresponds to the set number of printing operation times, where the character string is arranged within the print range along the circumference around the center of the recording medium based on the selected arrangement pattern; and repeatedly alternately performing: (i) an operation that causes each created print data to be printed on the recording medium by one printing operation in a state that the rotation of the recording medium is stopped, and (ii) an operation that causes the recording medium to be rotated by the set rotation angle before a next printing operation is started according to the set operational condition.

11. The printing method according to claim 10, further comprising the step of setting a character size of the character string based on the number of characters of the character string and the selected arrangement pattern, wherein in said operational condition setting step, the number of printing operation times and each operational condition of the rotation angle based on the set character size, the print range, and the selected arrangement pattern, in said print data creating step, the print data is created such that the character string with the set character size is arranged within the print range along the circumference around the center of the recording medium.

12. The printing method according to claim 10, further comprising the step of designating a character size of the character string, wherein in said operational condition setting step, the number of printing operation times, and each operational condition of the rotation angle are set based on the designated character size, the print range, and the selected arrangement pattern, in said print data creating step, the print data is created such that the character string with the set character size is arranged within the print range along the circumference around the center of the recording medium.

13. A program causing a computer to execute the steps of:

storing a character string to be printed;

selecting one arrangement pattern from a plurality kinds of arrangement patterns, being prepared in advance, for arranging the character string along a circle or arc having a predetermined length;

setting the number of printing operation times necessary to print the character string and each operational condition of a rotation angle of the recording medium corresponding to one printing operation based on a printable range by one printing operation and the selected arrangement pattern;

creating print data, which corresponds to the set number of printing operation times, where the character string is arranged within the print range along the circumference around the center of the recording medium based on the selected arrangement pattern; and repeatedly alternately performing: (i) an operation that causes each created print data to be printed on the recording medium by one printing operation in a state that the rotation of the recording medium is stopped, and (ii) an operation that causes the recording medium to be rotated by the set rotation angle before a next printing operation is started according to the set operational condition.

* * * * *